US006619167B2

(12) United States Patent
Mikkelsen et al.

(10) Patent No.: US 6,619,167 B2
(45) Date of Patent: Sep. 16, 2003

(54) METHOD AND APPARATUS FOR PRECISION CUTTING OF GRAPHICS AREAS FROM SHEETS

(76) Inventors: Steen Mikkelsen, 2343 S. Shore Dr., Delavan, WI (US) 53115; Geo Anderson, Johs. Ewalds Vej 48, Aabyhoej (DK), 8230

( * ) Notice: Subject to any disclaimer, the term of this patent is extended or adjusted under 35 U.S.C. 154(b) by 0 days.

(21) Appl. No.: 09/827,000

(22) Filed: Apr. 5, 2001

(65) Prior Publication Data

US 2002/0144578 A1 Oct. 10, 2002

(51) Int. Cl.[7] ..... B26D 5/00

(52) U.S. Cl. ..... 83/13; 83/39; 83/52; 83/75.5; 83/76.8; 83/364; 83/365; 83/368; 83/371; 83/940; 700/134; 700/171; 347/157

(58) Field of Search ..... 83/861, 862, 875, 83/879, 880, 881, 13, 22, 32, 34, 39, 52, 56, 72, 73, 74, 75, 75.5, 366, 76.8, 365, 76.9, 368, 371, 901, 936, 939, 940, 747; 700/114, 134, 213, 167, 150, 171, 230, 135, 259; 400/621; 347/157

(56) References Cited

U.S. PATENT DOCUMENTS

| | | | | |
|---|---|---|---|---|
| 3,242,573 A | | 3/1966 | Noel | |
| 3,608,799 A | | 9/1971 | Edson | |
| 3,803,960 A | | 4/1974 | Pearl et al. | |
| 3,805,650 A | * | 4/1974 | Pearl | 83/56 |
| 3,838,618 A | | 10/1974 | Eissfeldt et al. | |
| 3,848,490 A | | 11/1974 | Arel | |
| 3,855,887 A | | 12/1974 | Pearl et al. | |
| 3,864,997 A | | 2/1975 | Pearl et al. | |
| 4,071,899 A | | 1/1978 | Holy | |
| 4,083,095 A | | 4/1978 | Flaum et al. | |
| 4,380,944 A | | 4/1983 | Gerber et al. | |
| 4,419,913 A | | 12/1983 | Schutt et al. | |
| 4,494,435 A | | 1/1985 | Lindsay | |
| 4,555,968 A | * | 12/1985 | Raney et al. | 83/209 |
| 4,583,181 A | * | 4/1986 | Gerber et al. | 250/559.46 |
| 4,680,083 A | | 7/1987 | Kashiwaba | |
| 4,697,485 A | | 10/1987 | Raney | |
| 4,704,927 A | * | 11/1987 | Hirosawa | 83/13 |
| 4,721,058 A | * | 1/1988 | Hayamizu et al. | 118/39 |
| 4,768,410 A | * | 9/1988 | Wood | 235/489 |
| 4,827,140 A | | 5/1989 | Mohan | |
| 4,882,961 A | * | 11/1989 | Zabinski et al. | 83/177 |
| 4,901,359 A | * | 2/1990 | Bruder | 235/462.01 |
| 4,941,183 A | | 7/1990 | Bruder et al. | |
| 5,074,178 A | * | 12/1991 | Shetley et al. | 83/364 |
| 5,201,351 A | | 4/1993 | Hurdle, Jr. | |
| 5,212,647 A | | 5/1993 | Raney et al. | |
| 5,258,917 A | * | 11/1993 | Bruder et al. | 348/125 |
| 5,333,111 A | * | 7/1994 | Chaiken et al. | 382/111 |
| 5,537,135 A | | 7/1996 | Hevenor et al. | |
| 5,551,786 A | | 9/1996 | Webster et al. | |
| 5,644,979 A | | 7/1997 | Raney | |
| 5,727,433 A | | 3/1998 | Pomerleau et al. | |

(List continued on next page.)

*Primary Examiner*—Boyer D. Ashley
(74) *Attorney, Agent, or Firm*—Jansson, Shupe & Munger, Ltd.

(57) ABSTRACT

An improved method and apparatus for cutting a graphics area from a sheet of material which includes such graphics area. The method improved involves applying a plurality of registration marks on the sheet at and about the graphics area in predetermined positions at the time the graphics are applied thereto, the plurality of marks including a subset of marks (the subset preferably being a tandem pair of marks) which is applied on one side of the graphics area which are used to determine the position and orientation of the sheet, sensing the locations of the registration marks on the sheet of material at the time of cutting, and cutting the graphics area from the ready-to-cut sheet along a path determined in response to the sensed positions of the registration marks with respect to the graphics area at that time, whereby precise cutting occurs despite two-dimensional distortion of the sheet prior to cutting.

22 Claims, 1 Drawing Sheet

U.S. PATENT DOCUMENTS 5,794,526 A * 8/1998 Raney ..... 100/229 R
5,838,569 A * 11/1998 Gane ..... 700/134
5,937,725 A * 8/1999 Kamijo et al. ..... 83/56
6,112,630 A 9/2000 Miura
6,192,777 B1 * 2/2001 Williams et al. ..... 83/56
6,205,370 B1 * 3/2001 Blaimschein et al. ..... 382/111

* cited by examiner

METHOD AND APPARATUS FOR PRECISION CUTTING OF GRAPHICS AREAS FROM SHEETS

FIELD OF THE INVENTION

This invention is related generally to the field of cutting of graphics areas or the like from sheets for various purposes, and other narrow-path-processing about graphics areas on sheets.

BACKGROUND OF THE INVENTION

The technical field involving the cutting of graphic areas from sheets, or otherwise doing narrow-path-processing about graphics images on sheets, includes, for example, the face-cutting of laminate sheets to form decals. More specifically, a graphic-image area on the face layer of a laminate needs to be cut away from the remainder of the face layer so that the graphic area (decal) can subsequently be pulled away from the backing layer of the laminate and be applied elsewhere as intended. Highly accurate face-layer cutting about the graphics is obviously highly desirable.

This is but one example in which highly accurate sheet cutting is desirable. In many other situations, highly accurate sheet cutting which is desired may not involve face-cutting, but through-cutting, in which the full thickness of the sheet is cut about a graphics area on the sheet. And in many situations, rather than highly accurate cutting, highly accurate scoring, creasing, line embossing or the like, in each case, of course, along a line the varying direction of which is determined by the shape of the graphics area. Together these types of operations on sheets with respect to graphics areas thereon are referred to herein for convenience as "narrow-path-processing." For convenience, the prior art problems and the invention herein which solves such problems will be discussed primarily with reference to sheet-cutting apparatus.

A method and associated apparatus which addresses many of the problems encountered in such processing of sheet material is the i-cut™ vision cutting system from Mikkelsen Graphic Engineering of Lake Geneva, Wis., and is the subject of a U.S. patent application (Ser. No. 09/678,594—now U.S. Pat. No. _____) filed on Oct. 4, 2000. The invention described in such document is a method and apparatus for achieving highly improved accuracy in cutting around graphics areas in order to fully adjust for two-dimensional distortion in the sheets from which the graphics areas will be cut, including distortion of differing degrees in one dimension or along one direction on the sheet of material. The distortion may be from the printing process or from some other post-printing process such as material handling or during the cutting process itself. This invention also provides improved speed and accuracy in narrow-path-processing and greater efficiency of material usage.

In some cases, such as in the i-cut™ system from Mikkelsen Graphic Engineering, a flatbed plotter is used. These are devices having a positionally-controlled cutting implement above a flat work surface on which the sheet to be cut rests. The cutting implements are controlled based on controller-supplied instructions based on the X-Y coordinates necessary to achieve cutting along the intended path, such as about the graphics area.

Achieving greater speed and overall efficiencies in narrow-path-processing is a continuing challenge encountered with such systems. One source of inefficiency is the manual intervention often required to adjust the initial position and alignment of the sheet on the work surface of the cutting apparatus. Sheets of material on which graphics areas have been previously printed are placed on the work surface of the cutting apparatus, either manually or by automatic sheet-feeding equipment. In either of these set-up situations, the cutting apparatus must determine the position and orientation of the sheet on the work surface in order to proceed accurately with the cutting process. If the operator or automatic sheet-feeder places the sheet of material on the work surface such that it is outside of the area or region of alignment on the work surface which the cutting system expects to find the sheet, manual intervention may be necessary to adjust the placement of the sheet to within the required initial region in order for the process to continue beyond this initial set-up step. Another source of inefficiency is the time-consuming step which may be required to allow the system to determine the initial position and orientation of the sheet on the work surface.

Despite the significant advances represented by the i-cut™ system, these advances have not yet achieved the highest levels of efficiency which potentially can be reached by automated cutting systems.

OBJECTS OF THE INVENTION

It is an object of this invention to provide an improved method and apparatus for precision cutting of graphics areas from sheets, thereby overcoming some of the problems and shortcomings of the prior art.

Another object of this invention is to provide a method and apparatus for reducing the time to determine sheet position and orientation in apparatus for cutting around graphics areas in order to fully adjust for two-dimensional distortion in the sheets from which the graphics areas will be cut.

Another object of this invention is to allow for rapid cutting of graphics areas from the sheet material.

Another object of the invention is to minimize or completely eliminate the need for manual intervention by an operator in the placement of sheets of material on apparatus for cutting about graphics areas which automatically adjust for a wide variety of sheet distortion.

Still another object of this invention is to provide an improved method and apparatus for narrow-path-processing about graphics on sheet materials of various kinds.

These and other objects of the invention will be apparent from the following descriptions and from the drawings.

SUMMARY OF THE INVENTION

The instant invention overcomes the above-noted problems and satisfies the objects of the invention. The invention is an improved method and apparatus for cutting graphics areas from sheets. Stated more broadly, the invention is an improved method and apparatus for narrow-path-processing about graphics images on sheets, including by cutting, creasing, scoring or the like. Of particular note is that the instant invention combines high speed and efficiency (less manual intervention) and high-precision accuracy in the cutting of graphics images from sheets bearing such images which overcomes a wide variety of variable distortion in the sheets, including two-dimensional distortion.

The method of this invention, stated with respect to cutting graphics areas from sheets including such graphics areas, includes as a first step applying a plurality of registration marks on the sheet at and about the graphics area in predetermined positions with respect to the graphics area, or more particularly, with respect to the perimeter thereof which will be cut, the plurality of registration marks including an initial-position/orientation-determining subset located on no more than one side of the graphics area. This is done at the time the graphics which define such graphics area (or graphics areas) are applied. The method involves: placing the graphics sheet with the initial-position/orientation-determining subset adjacent to a registration mark sensor; sensing the subset to determine the position and orientation of the sheet of material and the approximate positions of the plurality of registration marks thereon; sensing the precise positions of the registration marks on the sheet of material; and cutting the graphics area from the ready-to-cut sheet in response to the precise positions of the registration marks with respect to the graphics area at that time. This method allows the sensing of the registration marks to occur rapidly with a minimum of manual intervention and cutting to occur precisely despite two-dimensional distortion of the sheet prior to cutting.

In highly preferred embodiments of the invention, the initial-position/orientation-determining subset is a pair of registration marks in tandem relationship to each other. The term "tandem relationship" as used herein means spaced closer to one another than the average spacing between other registration marks applied on the sheet of material. For example, on a sheet of material one meter by one meter in size with graphics areas applied including registration marks around the perimeters of the graphics areas, two registration marks applied near one corner of the sheet with a 25 mm space between the centers of the two marks are said to be in tandem relationship with each other.

In certain preferred embodiments, each of the registration marks of the pair is a round area, and the sensing step includes processing sensed data to determine the mathematical centers thereof Further, in highly preferred embodiments, all of the registration marks are round areas, and the sensing step includes processing sensed data to determine the mathematical centers thereof.

It is highly preferred that the method of this invention include providing a controller to furnish instructions for the sensing and cutting operations so that the determinations involving sensing and cutting are carried out swiftly and on a continuing basis as one or more graphics areas are cut from a sheet and as additional sheets are processed. The controller further facilitates the efficiency improvements of this invention.

In highly preferred embodiments, the method includes the additional step of placing the ready-to-cut sheet on a flatbed plotter having an X and Y coordinate grid and retaining the sheet on the flatbed plotter at a user-selected location thereon such that the sheet of material overlaps the X and Y coordinate grid. In such preferred embodiments, the sensing of the precise positions of the registration marks on the ready-to-cut sheet includes the step of determining the X and Y coordinates which are overlapped by the registration marks. Further, preferred embodiments of the invention include in the cutting process the step of comparing the X and Y coordinates which are overlapped by the registration marks with a reference set of X and Y coordinates. In highly preferred embodiments, the comparing step is carried out by the controller.

In certain preferred embodiments, the controller has a programmed set of predetermined cutting instructions which includes reference X and Y coordinates for the registration marks and the predetermined positions thereof with respect to the perimeter of the graphics area when the graphics area and registration marks are first applied to the sheet. In such embodiments, the cutting step includes setting an optimized cutting path based on the comparing step, such optimized cutting path corresponding to the perimeter of the graphics area of the ready-to-cut sheet even though such perimeter is distorted during the uncut life of the sheet.

In certain preferred embodiments, the sheet is a laminate having (a) a face layer which bears one or more graphics areas and registration marks corresponding to each, and (b) a backing layer, and the cutting is face cutting only. This allows preparation of highly accurate decals, which can later be removed from the backing layer.

In many cases, depending on the size of the sheet, it is preferred that there be a plurality of graphics areas on each sheet and a corresponding plurality of sets of the registration marks at or about each graphics area.

The apparatus of this invention is a device for cutting a graphics area at the perimeter thereof from a ready-to-cut sheet of material, the sheet having a plurality of registration marks at and about the graphics area, the plurality of registration marks including an initial-position/orientation-determining subset located on no more than one side of the graphics area. The registration marks are simply added during the printing of the graphics area.

The inventive apparatus includes: (1) a flatbed plotter having an upper surface for receiving the ready-to-cut sheet thereon; (2) a sensor, preferably a CCD area image sensor, operatively connected to the flatbed plotter for moving along the upper surface thereof, the sensor sensing the locations of the registration marks; (3) a cutter operatively connected to the sensor and movable about the upper surface of the flatbed plotter, the cutter cutting the graphics area from the ready-to-cut sheet in response to the locations of the registration marks sensed by the sensor; and (4) a controller operatively connecting the cutter to the sensor to control movement of the cutter along the upper surface of the flatbed plotter, the controller including a set of initialization instructions corresponding to (a) predetermined approximate positions of the initial-position/orientation-determining subset on the sheet and (b) the relative positions of the remaining registration marks thereon with respect to the position of the subset. The invention, as already indicated, allows the sensing of the registration marks to occur rapidly with a minimum of manual intervention and cutting to occur precisely despite two-dimensional distortion of the sheet prior to cutting.

In preferred embodiments, the initialization instructions of the controller also include instructions for determining the precise position and orientation of the subset, whereby the approximate positions of the remaining registration marks are determined to facilitate determination of the precise positions of the remaining registration marks.

Further, the controller includes a set of predetermined cutting instructions therein corresponding to the perimeter of the graphics area and the predetermined position thereof with respect to predetermined positions of the registration marks when the graphics area and registration marks are first applied to the sheet, the controller moving the cutter along the upper surface of the flatbed plotter in response to a comparison of (a) the locations of the registration marks sensed by the sensor on the ready-to-cut sheet with (b) the set of predetermined cutting instructions.

DETAILED DESCRIPTION OF PREFERRED EMBODIMENTS

Figure 1:
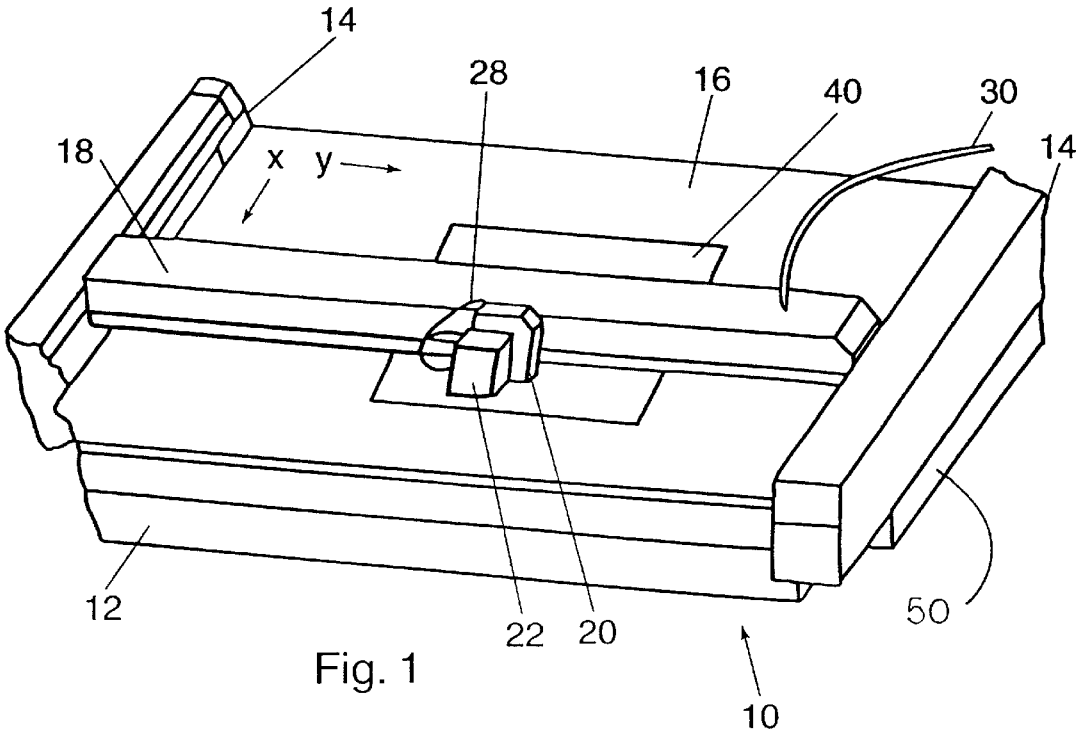
FIG. 1 is a perspective view of an automatically controlled cutting apparatus employing the present invention.

Referring to FIG. 1, a partially cut away view of a cutting device 10 is shown. Cutting device 10 has a housing 12 which may contain the control system or controller 50 and a work surface 16. Cutting device 10 is also known as a flatbed plotter or cutter in the art and may be a Zund plotter, manufactured by Zund System Technik HG, or a Wild plotter, to give two examples.

The work surface cutting device 10 is shown with a sheet 40 positioned on it. Cutting device 10 is shown with two longitudinal guide rails 14 mounted thereon. A transverse member 18 is suspended between longitudinal guide rails 14. Transverse member 18 is driven by a motor (not shown) along guide rails 14. A cutting tool 20 rides on transverse member 18. Cutting tool 20 has a cutting knife (not shown).

A sensor or detector 22 is shown attached to cutting tool 20. While sensor or detector 22 is shown attached to cutting tool 10, it is not necessary for it to be attached to it. Cutting tool 20 moves along transverse member 18 and is driven by a motor (not shown). Cutting tool 20 is capable of moving laterally or longitudinally along work surface 16. Cutting tool 20 may have pressure and tangential controlled tungsten carbide blades, tungsten carbide blades, other blades that are generally known or lasers, which are not shown. The cutter driver (not shown) which controls cutting tool 20 is standard and is known in the art.

Figure 2:
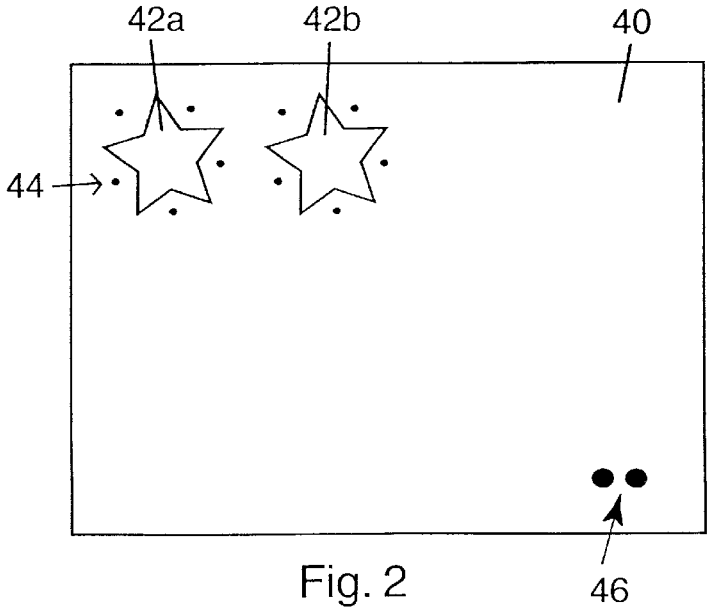
FIG. 2 is a top view of a sheet of sheet material with pre-printed graphics areas and registration marks, including an initial-position/orientation-determining subset of marks.

Sensor or detector 22 may be an optical detector responsive to registration marks on sheet 40. Referring to FIG. 2, registration marks 44 are pre-printed on sheet 40. Registration marks 44 are pre-printed circles, filled or unfilled, of equal size. They may be anywhere from 3 mm to 12 mm in diameter, with a preferred outer diameter of 6.3 mm. The color of the registration marks is such as to create sufficient contrast to the background of the sheet material.

Sheet 40 has many registration marks 44 preprinted thereon, including several around each of the graphics areas 42*a* and 42*b* which are intended to be cut from sheet 40. Registration marks 44 are adjacent to, but not contiguous with, the perimeters of preprinted graphics areas 42*a* and 42*b*. Registration marks 46 are the initial-position/orientation-determining subset of marks which are on only one side of the graphics areas 42*a* and 42*b*. These marks 46 are arranged in tandem relationship to each other and are placed only to one side of graphics areas 42*a* and 42*b* to facilitate rapid determination of their positions relative to work surface 16.

Sensor 22 is connected to the input of the controller by cables 28 and 30. The controller (not shown) is also connected to and drives cutting tool 20. The controller receives the input external data and compares it to the format and content of information which it has stored in it. For each graphics area 42*a* and 42*b*, the information stored in the controller is the location of the perimeter of the graphics area relative to the locations of registration marks 44 as printed on sheet 40. Specifically, the controller has the position of the registration marks 44 and the intended cutting path defined in X-Y coordinates.

After graphics areas 42*a* and 42*b* and registration marks 44 and initial-position/orientation-determining subset of marks 46 have been printed on sheet 40, sheet 40 is placed on work surface 16 at an initial position and orientation approximately equal to a predetermined initial position and orientation expected by controller. The controller instructs sensor 22 to determine the precise positions of the mathematical centers of initial-position/orientation-determining subset of marks 46 and defines these positions in X-Y coordinates of work surface 16. This information is then used to determine the position and orientation of sheet 40 on work surface 16. Once the position and orientation of sheet 40 are known, the controller uses the stored information on the relative location of registration marks 44, in conjunction with sensors 22, to determine the precise positions of registration marks 44.

The controller compares the actual distance between the three registration marks (44) which are closest to a point on the intended cutting point, and adjusts the cutting path according to the changes between these registration marks using the information for their locations when printed on sheet 40. The adjustments are made by making changes in the X-Y coordinates of points along the cutting path.

The sensor or detector 22 may be a CCD camera, which is known in the art. The cutter drivers (not shown) are also known in the art. In operation, sensor 22 is caused to be positioned over a registration mark 44. Sensor 22 finds the mathematical center of a registration mark 44 and defines its position in X-Y coordinates of work surface 16. Two other registration marks 44 are located and their centers are defined by X-Y coordinates in like manner.

These data are inputted to the controller where the actual locations of registration marks 44 on ready-to-be-cut sheet 40 are compared to those of the registration marks in the predetermined cutting instructions. The predetermined cutting path which is a collection of X-Y coordinate sets is adjusted according to the actual X-Y coordinates of registration marks 44. These comparisons are made interactively throughout the cutting process, making the process a dynamic process.

The cutting path is adjusted according to the actual coordinates of the three registration marks 44 closest to a cutting point. When the cutting of an individual graphics area is completed, cutting tool 20 is caused to be lifted and moved to the next graphics area and the process is repeated.

In the operating mode, sheet material 40 is placed on work surface 16 and may be held in place by a vacuum which acts through the work surface. The cutting of graphics areas 42*a* and 42*b* is effected by movement of computer-controlled cutting tool 20 and computer-controlled transverse rail 18. The predetermined cutting instructions contained in the controller are based upon the graphics area which was originally printed on sheet 40. The cutting path is defined in X-Y coordinates.

As already noted, sensor 22 finds the locations of registration marks 44 and defines them in X-Y coordinates. This information is compared to the predetermined X-Y coordinates of the registration marks, and the cutting path along the perimeters of the graphics areas are adjusted according to the changes in the location of the three registration marks are closest to each cutting point. The cutting path is optimized and modified dynamically as the cutting proceeds.

The method and apparatus of this invention have a wide range of applications in a variety of industries. The invention also has application to sheets in the form of curved surfaces, in certain situations. Furthermore, the applicability of the invention is not limited to any particular kind or form of sheet.

While the principles of this invention have been described in connection with specific embodiments, it should be understood clearly that these descriptions are made only by way of example and are not intended to limit the scope of the invention. Note that while two round marks are shown as initial-position/orientation-determining subset of marks 46, numerous other combinations of shapes and sizes of subset marks are sufficient to determine the position and orientation of sheet 40 on work surface 16. For example, with the sensor and controller properly programmed, a single rectangular mark would also provide sufficient information for this determination.

What is claimed is:

1. An apparatus for cutting a graphics area at the perimeter thereof from a ready-to-cut sheet of material, the sheet of material having a plurality of registration marks at and about the graphics area and the plurality of registration marks including an initial-position/orientation-determining subset located on no more than one side of the graphics area, the apparatus comprising:

a flatbed plotter having an upper surface for receiving the ready-to-cut sheet of material thereon;

a sensor operatively connected to the flatbed plotter for moving along the upper surface thereof, the sensor configured to detect locations of the registration marks;

a cutter operatively connected to the sensor and movable about the upper surface of the flatbed plotter, the operative connection between the cutter and sensor designed to communicate the locations of the registration marks to the cutter, the cutter adapted to cut the graphics area from the ready-to-cut sheet of material based on the locations of the registration marks; and a controller operatively connecting the cutter to the sensor, the controller including a set of initialization instructions corresponding to (a) predetermined approximate positions of the initial-position/orientation-determining subset on the sheet of material and (b) relative positions of remaining registration marks thereon with respect to the predetermined approximate positions of the subset, the controller configured to control movement of the cutter along the upper surface of the flatbed plotter to precisely cut the graphics area at the perimeter thereof despite any two-dimensional distortion of the sheet of material.

2. The apparatus of claim 1 wherein the initialization instructions include instructions for ascertaining a precise position and orientation of the subset, whereby approximate positions of the remaining registration marks are inferred to facilitate sensing of precise positions of the remaining registration marks.

3. The apparatus of claim 2 wherein the controller includes a set of predetermined cutting instructions therein corresponding to the perimeter of the graphics area and a predetermined position thereof with respect to predetermined positions of the registration marks when the graphics area and registration marks are first applied to the sheet of material, the controller moving the cutter along the upper surface of the flatbed plotter in response to a comparison of (a) the locations of the registration marks sensed by the sensor on the ready-to-cut sheet of material with (b) the set of predetermined cutting instructions.

4. The apparatus of claim 2 wherein the sensor is a CCD area image sensor.

5. A method for narrow-path-processing about a graphics area on a sheet of material which includes such graphics area, comprising:

applying a plurality of registration marks on the sheet of material at and about the graphics area in predetermined positions with respect thereto at the time the graphics which define such graphics area are applied, the plurality of registration marks including an initial-position/orientation-determining subset located on no more than one side of the graphics area;

placing the sheet of material with the initial-position/orientation-determining subset adjacent to a registration mark sensor;

sensing the subset to ascertain a position and orientation of the sheet of material and approximate positions of the plurality of registration marks thereon;

sensing precise positions of the registration marks on the sheet of material at the time of narrow-path-processing; and narrow-path-processing about the graphics area from the sheet of material in response to the positions of the registration marks with respect to the graphics area at that time, whereby narrow-path-processing occurs precisely despite two-dimensional distortion of the sheet of material prior to processing.

6. The method of claim 5 wherein the narrow-path-processing is a processing step selected from the group consisting of cutting, scoring, creasing and line embossing.

7. The method of claim 5 wherein the initial-position/orientation-determining subset is a pair of registration marks in tandem relationship to each other.

8. The method of claim 7 wherein each of the registration marks of the pair is a round area having a mathematical center, and the sensing step includes processing sensed data to find the mathematical centers thereof.

9. The method of claim 8 wherein all of the registration marks are round areas having mathematical centers, and the sensing step includes processing sensed data to find the mathematical centers thereof.

10. A method for cutting a graphics area from a sheet of material which includes such graphics area, comprising:

applying a plurality of registration marks on the sheet of material at and about the graphics area in predetermined positions with respect thereto at the time the graphics which define such graphics area are applied, the plurality of registration marks including an initial-position/orientation-determining subset located on no more than one side of the graphics area;

placing the graphics sheet of material with the initial-position/orientation-determining subset adjacent to a registration mark sensor;

sensing the subset to ascertain a position and orientation of the sheet of material and approximate positions of the plurality of registration marks thereon;

sensing precise positions of the registration marks on the sheet of material; and cutting the graphics area from the sheet of material in response to the precise positions of the registration marks with respect to the graphics area at that time, whereby cutting occurs precisely despite two-dimensional distortion of the sheet of material prior to cutting.

11. The method of claim 10 wherein the sheet has a plurality of graphics areas thereon and corresponding plurality of sets of the registration marks.

12. The method of claim 10 wherein:

the sheet of material is a laminate having (a) a face layer bearing the graphics area and registration marks and (b) a backing layer; and the cutting is face cutting only.

13. The method of claim 12 wherein the sheet of material has a plurality of graphics areas thereon and corresponding plurality of sets of the registration marks.

14. The method of claim 10 wherein the initial-position/orientation-determining subset is a pair of registration marks in tandem relationship to each other.

15. The method of claim 14 wherein each of the registration marks of the pair is a round area having a mathematical center, and the sensing step includes processing sensed data to find the mathematical centers thereof.

16. The method of claim 15 wherein all of the registration marks are round areas having mathematical centers, and the sensing step includes processing sensed data to find the mathematical centers thereof.

17. The method of claim 10 wherein the sensing and cutting are carried out in response to a set of instructions from a controller.

18. The method of claim 17 comprising the additional step of placing the sheet of material on a flatbed plotter having an X and Y coordinate grid and retaining the sheet of material on the flatbed plotter at a user-selected location thereon such the sheet of material overlaps the X and Y coordinate grid.

19. The method of claim 18 wherein the controller has a programmed set of predetermined cutting instructions which includes reference X and Y coordinates for the registration marks and the predetermined positions thereof with respect to the perimeter of the graphics area when the graphics area and registration marks are first applied to the sheet of material, and wherein the cutting step further includes setting an optimized cutting path based on the comparing step, such optimized cutting path corresponding to the perimeter of the graphics area of the sheet of material even though such perimeter is distorted after the applying step.

20. The method of claim 18 wherein the step of sensing the precise positions of the registration marks on the sheet of material includes the step of acquiring X and Y coordinates which are overlapped by the registration marks.

21. The method of claim 20 wherein the cutting step includes the step of comparing the X and Y coordinates which are overlapped by the registration marks with a reference set of X and Y coordinates.

22. The method of claim 21 wherein the comparing step is carried out by the controller.

* * * * *